US012742453B2

(12) United States Patent
Garrison et al.

(10) Patent No.: US 12,742,453 B2
(45) Date of Patent: Sep. 22, 2026

(54) COUNTERFLOW GUIDE FOR FLUID END

(71) Applicant: GD Energy Products, LLC, Tulsa, OK (US)

(72) Inventors: Jacob Gregory Garrison, Tulsa, OK (US); Adam Bradley Avey, Tulsa, OK (US); Konner Casey Kay, Broken Arrow, OK (US)

(73) Assignee: GD ENERGY PRODUCTS, LLC, Tulsa, OK (US)

( * ) Notice: Subject to any disclaimer, the term of this patent is extended or adjusted under 35 U.S.C. 154(b) by 7 days.

(21) Appl. No.: 18/903,212

(22) Filed: Oct. 1, 2024

(65) Prior Publication Data

US 2025/0122866 A1 Apr. 17, 2025

Related U.S. Application Data

(60) Provisional application No. 63/589,739, filed on Oct. 12, 2023.

(51) Int. Cl.
*F04B 53/10* (2006.01)
*F04B 53/16* (2006.01)
*F04B 53/22* (2006.01)

(52) U.S. Cl.
CPC ..... *F04B 53/109* (2013.01); *F04B 53/16* (2013.01); *F04B 53/22* (2013.01)

(58) Field of Classification Search
CPC ..... F04B 1/04; F04B 1/0404; F04B 1/0452; F04B 1/0456; F04B 1/053; F04B 15/02; F04B 17/00; F04B 17/03; F04B 17/06; F04B 47/00; F04B 53/006; F04B 53/007; F04B 53/10; F04B 53/109; F04B 53/16; F04B 53/22; E21B 43/26; E21B 43/2607; F16K 2200/20; F16K 2200/204; F16K 2200/50; F16K 2200/501; F16K 2200/502; F16K 15/021; F16K 15/023; F16K 2200/201; Y10T 137/2544
USPC ..... 417/567; 137/102
See application file for complete search history.

(56) References Cited

U.S. PATENT DOCUMENTS

| | | | |
|---|---|---|---|
| 4,032,263 | A | 6/1977 | Pareja |
| 4,239,463 | A | 12/1980 | Yaindl |
| 4,494,415 | A | 1/1985 | Elliston |
| 4,551,077 | A | 11/1985 | Pacht |

(Continued)

FOREIGN PATENT DOCUMENTS

EP 0580196 A1 1/1994

OTHER PUBLICATIONS

International Search Report and Written Opinion in counterpart International Application No. PCT/US2024/049555, mailed Dec. 2, 2024, 17 pages.

*Primary Examiner* — Bryan M Lettman
*Assistant Examiner* — Chirag Jariwala
(74) *Attorney, Agent, or Firm* — Edell, Shapiro & Finnan, LLC

(57) ABSTRACT

A counterflow guide includes a body with a first end surface, a second end surface positioned opposite the first end surface, and a sidewall connecting the first end surface to the second end surface. The counterflow guide also includes a discharge passage configured to direct a fluid to discharge through the body, from a discharge inlet to a discharge outlet. The discharge inlet is formed in the sidewall and the discharge outlet is formed into the first end surface.

20 Claims, 12 Drawing Sheets

(56) References Cited

U.S. PATENT DOCUMENTS 4,924,901 A * 5/1990 Valavaara ..... F04B 53/109 137/627.5
5,064,354 A 11/1991 Robertson et al.
5,147,189 A 9/1992 Barnowski
5,605,449 A 2/1997 Reed
5,636,975 A * 6/1997 Tiffany et al. ..... F04B 53/109 417/454
5,924,853 A 7/1999 Pacht
8,240,634 B2 8/2012 Jarchau et al.
9,188,122 B1 11/2015 Reed
9,670,922 B2 6/2017 Pacht
10,767,773 B2 9/2020 Lee
11,162,479 B2 11/2021 Thomas et al.
11,208,996 B2 12/2021 Foster et al.
11,300,111 B2 4/2022 Thomas et al.
11,346,339 B2 5/2022 Nowell et al.
11,359,615 B2 6/2022 Thomas et al.
2005/0257927 A1* 11/2005 Coyes ..... E21B 43/127 166/325
2014/0088482 A1* 3/2014 Schlaeper ..... A61M 39/223 604/246
2015/0071803 A1* 3/2015 Huang ..... F04B 39/1046 417/560
2015/0211641 A1 7/2015 Pacht
2021/0148208 A1 5/2021 Thomas et al.
2021/0148345 A1 5/2021 Thomas et al.
2021/0148346 A1 5/2021 Foster et al.
2021/0341079 A1 11/2021 Thomas et al.
2022/0049686 A1 2/2022 Thomas et al.
2022/0099073 A1 3/2022 Thomas et al.
2022/0106951 A1 4/2022 Foster et al.
2022/0163034 A1 5/2022 Foster et al.
2022/0235751 A1 7/2022 Thomas et al.
2022/0243724 A1* 8/2022 Li ..... F04B 1/053
2022/0282717 A1 9/2022 Thomas et al.
2022/0282725 A1 9/2022 Nowell et al.
2022/0307486 A1 9/2022 Thomas et al.
2022/0381234 A1 12/2022 Son et al.
2022/0389916 A1 12/2022 Keith et al.
2022/0397107 A1 12/2022 Thomas et al.
2023/0003207 A1 1/2023 Foster et al.
2023/0012666 A1 1/2023 Keith et al.
2023/0022890 A1 1/2023 Thomas et al.
2023/0047066 A1 2/2023 Barnett
2023/0050603 A1 2/2023 Foster et al.
2023/0160382 A1 5/2023 Thomas et al.

* cited by examiner

COUNTERFLOW GUIDE FOR FLUID END

CROSS-REFERENCE TO PREVIOUS APPLICATION

This application claims priority to and the benefit of U.S. Provisional Patent Application No. 63/589,739, entitled "COUNTERFLOW GUIDE FOR FLUID END," filed Oct. 12, 2023, and hereby incorporated by reference in its entirety for all purposes.

TECHNICAL FIELD

The present disclosure relates to the field of high pressure reciprocating pumps and, in particular, to a counterflow guide utilized in a fluid end of a high pressure reciprocating pump.

BACKGROUND

High pressure reciprocating pumps are often used to deliver high pressure fluids during earth drilling operations. Generally, a reciprocating pump includes a power end and a fluid end. The power end can generate forces sufficient to cause the fluid end to deliver high pressure fluids to earth drilling operations. For example, the power end includes a crankshaft that drives a plurality of reciprocating plungers or pistons near or within the fluid end to pump fluid at high pressure. The fluid end includes a chamber in which fluid is received and pressurized via the reciprocating plungers of the power end. Arrangement of the fluid end to receive, contain, and discharge fluid may be complex.

SUMMARY

The present application relates to a counterflow guide of a fluid end of a high pressure reciprocating pump. The techniques may be embodied as a counterflow guide or a counterflow guide assembly. As is detailed below, the counterflow guide of the present application might include one or more valves and/or may define one or more valve seats or surfaces configured to support valve seats. Thus, the "counterflow guide" may sometimes be referred to as a counterflow valve. Alternatively, the counterflow guide may be referred to as a routing plug, a fluid router, and the like.

In accordance with at least one embodiment, the present application is directed to a counterflow guide that includes a body with a first end surface, a second end surface positioned opposite the first end surface, and a sidewall connecting the first end surface to the second end surface. The counterflow guide also includes a discharge passage configured to direct a fluid to discharge through the body, from a discharge inlet to a discharge outlet. The discharge inlet is formed in the sidewall, and the discharge outlet is formed into the first end surface.

In accordance with at least another embodiment, the present application is directed to a counterflow guide that includes a first end surface, a second end surface positioned opposite the first end surface, and a sidewall connecting the first end surface and the second end surface to one another. The counterflow guide also includes a suction passage configured to direct fluid from the sidewall, into the body, and to the first end surface and a discharge passage configured to direct fluid from the sidewall, into the body, and to the second end surface.

In accordance with yet another embodiment, the present application is directed to a counterflow guide assembly that includes a first end surface, a second end surface positioned opposite the first end surface, a sidewall connecting the first end surface and the second end surface to one another, and a discharge passage configured to direct fluid from the sidewall to the first end surface to discharge the fluid from the counterflow guide. The counterflow guide assembly also includes a first valve configured to seal an opening formed into the first end surface of the counterflow guide and a second valve configured to seal an additional opening formed into the second end surface of the counterflow guide.

BRIEF DESCRIPTION OF THE DRAWINGS

The apparatuses, systems, and components presented herein may be better understood with reference to the following drawings and description. It should be understood that some elements in the figures may not necessarily be to scale and that emphasis has been placed upon illustrating the principles disclosed herein. In the figures, like-referenced numerals designate corresponding parts throughout the different views.

DETAILED DESCRIPTION

In the following detailed description, reference is made to the accompanying figures which form a part hereof wherein like numerals designate like parts throughout, and in which is shown, by way of illustration, embodiments that may be practiced. It is to be understood that other embodiments may be utilized, and structural or logical changes may be made without departing from the scope of the present disclosure. Therefore, the following detailed description is not to be taken in a limiting sense, and the scope of embodiments is defined by the appended claims and their equivalents.

Aspects of the disclosure are disclosed in the description herein. Alternate embodiments of the present disclosure and their equivalents may be devised without parting from the spirit or scope of the present disclosure. It should be noted that any discussion herein regarding "one embodiment", "an embodiment", "an exemplary embodiment", and the like indicate that the embodiment described may include a particular feature, structure, or characteristic, and that such particular feature, structure, or characteristic may not necessarily be included in every embodiment. In addition, references to the foregoing do not necessarily comprise a reference to the same embodiment. Finally, irrespective of whether it is explicitly described, one of ordinary skill in the art would readily appreciate that each of the particular features, structures, or characteristics of the given embodiments may be utilized in connection or combination with those of any other embodiment discussed herein.

Various operations may be described as multiple discrete actions or operations in turn, in a manner that is most helpful in understanding the claimed subject matter. However, the order of description should not be construed as to imply that these operations are necessarily order dependent. In particular, these operations may not be performed in the order of presentation. Operations described may be performed in a different order than the described embodiment. Various additional operations may be performed and/or described operations may be omitted in additional embodiments.

For the purposes of the present disclosure, the phrase "A and/or B" means (A), (B), or (A and B). For the purposes of the present disclosure, the phrase "A, B, and/or C" means (A), (B), (C), (A and B), (A and C), (B and C), or (A, B and C).

The terms "comprising," "including," "having," and the like, as used with respect to embodiments of the present disclosure, are synonymous.

Figure 1:
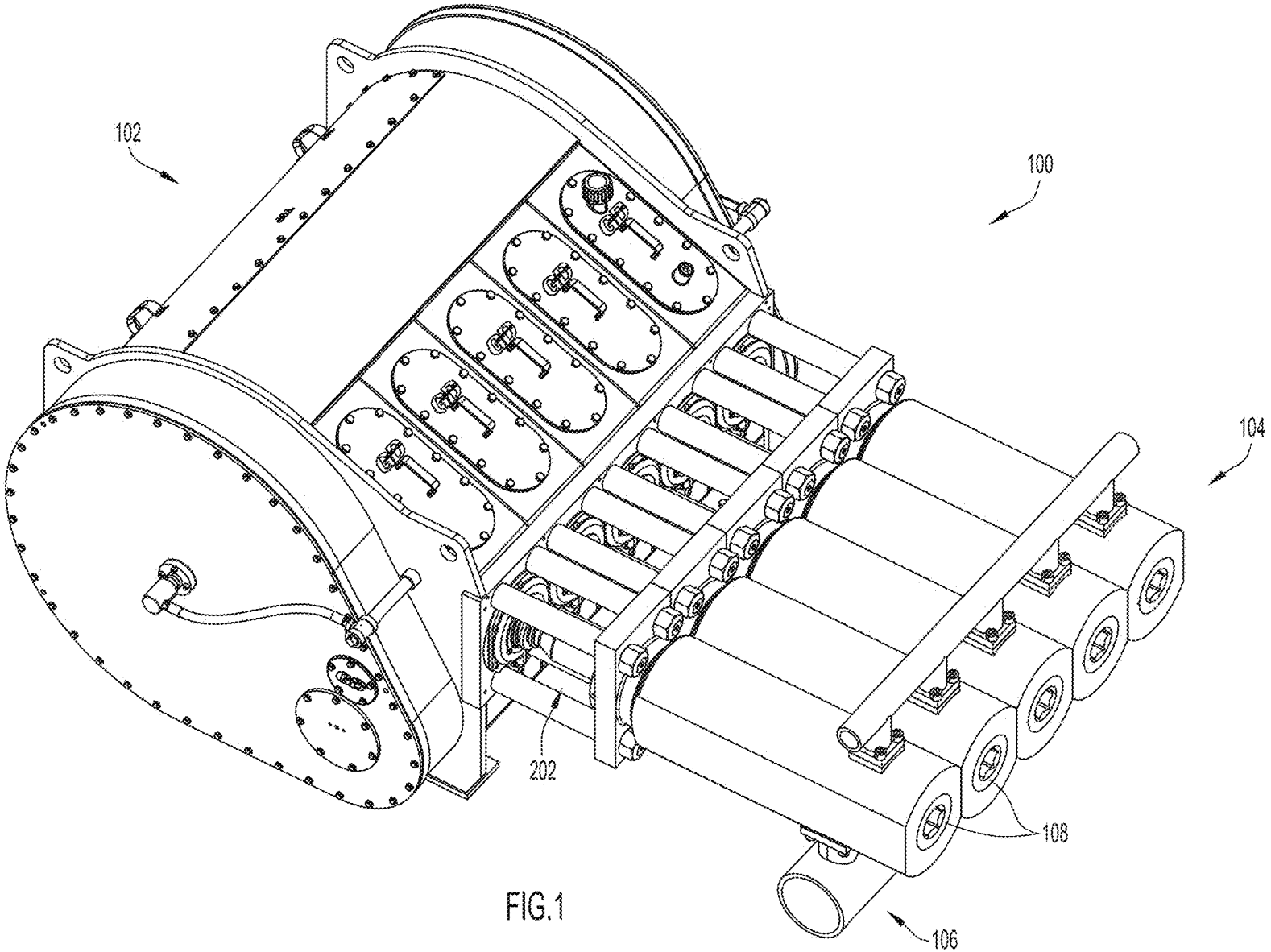
FIG. 1 is a perspective view of a reciprocating pump including a fluid end, in accordance with aspects of the present disclosure.

Referring to FIG. 1, depicted is a reciprocating pump 100 (e.g., a linear reciprocating pump). The reciprocating pump 100 includes a power end 102 and a fluid end 104. The power end 102 includes a crankshaft that drives a plurality of reciprocating plungers within the fluid end 104 to pump fluid at high pressure. Generally, the power end 102 is capable of generating forces sufficient to cause the fluid end 104 to deliver high pressure fluids to earth drilling operations. For example, the power end 102 may be configured to support hydraulic fracturing (i.e., fracking) operations, where fracking liquid (e.g., a mixture of water and sand) is injected into rock formations at high pressures to allow natural oil and gas to be extracted from the rock formations. However, to be clear, this example is not intended to be limiting and the present application may be applicable to both fracking and drilling operations.

Figure 2:
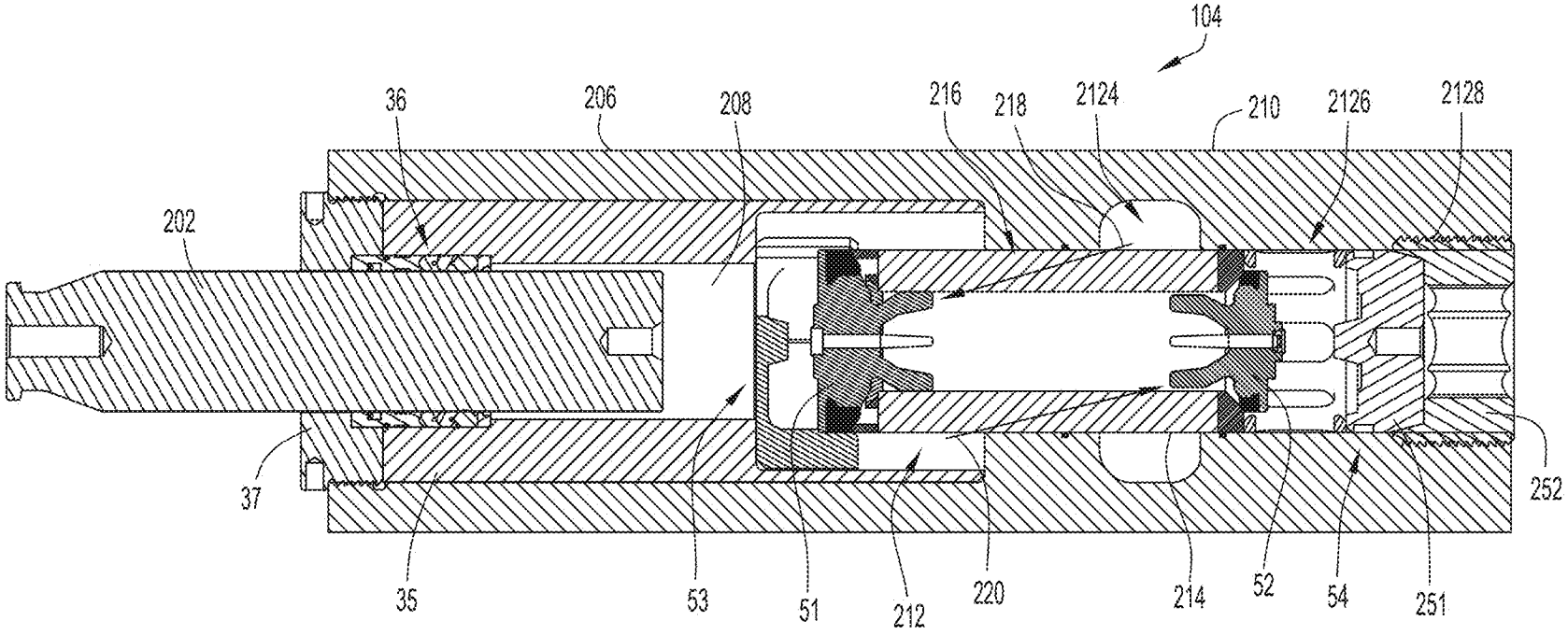
FIG. 2 is a side cross sectional view of another fluid end, in accordance with aspects of the present disclosure.

FIG. 2 shows a side cross-sectional sectional view of a fluid end 104, such as the fluid end 104 shown in FIG. 1. The sectional view of FIG. 2 is taken along a central axis of a reciprocating element 202, which may be a plunger or a piston. Although FIG. 2 depicts a single pumping chamber 208 (e.g., a pressure chamber, a plunger chamber), it should be understood that a fluid end 104 can include multiple pumping chambers 208 arranged side-by-side. In fact, in at least some embodiments, a casing 206 of the fluid end 104 forms a plurality of pumping chambers 208, and each pumping chamber 208 includes a reciprocating element 202 that reciprocates within the casing 206. However, side-by-side pumping chambers 208 need not be defined by a single casing 206. For example, in some embodiments, the fluid end 104 may be modular, and different casing segments may house one or more pumping chambers 208. In any case, the one or more pumping chambers 208 are arranged side-by-side so that corresponding conduits are positioned adjacent to each other and generate substantially parallel pumping action. Specifically, with each stroke of the reciprocating element 202, low pressure fluid is drawn into the pumping chamber 208 and high pressure fluid is discharged from the pumping chamber 208.

As can be seen in FIG. 2, the pumping paths and pumping chamber 208 of the fluid end 104 are formed by a conduit 212 that extends through the casing 206 to define openings at an external surface 210 of the casing 206. More specifically, the conduit 212 generally extends longitudinally along the same axis/direction as that of the reciprocating element 202. In FIG. 2, the conduit 212 is substantially cylindrical, but the diameter of the conduit 212 may vary throughout the casing 206.

Regardless of the diameters of the conduit 212, the conduit 212 includes two portions, each of which are fluidly coupled to the pumping chamber 208 and to the external surface 210 of the casing 206. Specifically, the conduit 212 includes a first portion 2124 and a second portion 2126. The conduit 212 defines a fluid path through the fluid end 104 via the first portion 2124 and the second portion 2126. The first portion 2124 is an intake portion (e.g., a suction inlet) that connects the pumping chamber 208 to a piping system 106 (see FIG. 1) delivering fluid to the fluid end 104. Meanwhile, the second portion 2126 is an outlet or discharge portion (e.g., a discharge chamber) that allows compressed fluid to exit the fluid end 104. In at least some embodiments, reciprocation of the reciprocating element 202 causes fluid to enter the first portion 2124 via pipes of the piping system 106, through the pumping chamber 208, and then through the second portion 2126 into a channel 108 (see FIG. 1). However, the piping system 106 and the channel 108 are merely example conduits and, in various embodiments, the fluid end 104 may receive and discharge fluid via any quantity of pipes and/or conduits, along pathways of any desirable size or shape.

The fluid end 104 includes a counterflow guide 214 to control fluid flow through the pumping chamber 208 during operation of the fluid end 104. For example, the counterflow guide 214 defines a flow path 216 to enable fluid flow into the fluid end 104 and out of the fluid end 104. More specifically, the counterflow guide 214 overlaps with the first portion 2124 of the conduit 212 and is configured to receive fluid flow entering the fluid end 104 via the first portion 2124. The counterflow guide 214 is configured to direct the fluid flow from the first portion 2124 to the pumping chamber 208 along the flow path 216 in a first direction 218. The counterflow guide 214 also overlaps with the second portion 2126 of the conduit 212 and is configured to direct fluid flow from the pumping chamber 208 to the second portion 2126 along the 216 in a second direction 220. As such, the counterflow guide 214 controls fluid flow into and out of the fluid end 104.

Additionally, valves 51, 52 (e.g., one-way valves), respectively allow fluid flow selectively through the counterflow guide 214 via the portions 2124, 2126. That is, the valves 51, 52 work with the counterflow guide 214 to control fluid flow through the fluid end 104. The valve 51 (e.g., a suction valve) may be secured within the conduit 212 by a first assembly 53 (e.g., a first closure assembly). The valve 52 (e.g., a discharge valve) may be secured within the conduit 212 by a second assembly 54 (e.g., a second closure assembly). In the illustrated embodiment, the second assembly 54 includes a closure element 251 (e.g., a discharge plug) that is secured in the second portion 2126 by a retaining assembly 252. In the depicted embodiment, the retaining assembly 252 is coupled to the second portion 2126 via threads 2128 and is removable from the casing 206 to provide access to parts disposed within the casing 206 and/or surfaces defined within casing 206. For example, the retaining assembly 252 may be threadably disengaged from the second portion 2126 and removed from within the casing 206 to provide access to the closure element 251, and the closure element 251 can be subsequently removed to provide access to the valves 51, 52 and/or to the counterflow guide 214, such as for maintenance, inspection, and/or replacement. However, the retaining assembly 252 need not be threadably coupled to the casing 206 and can be coupled thereto in any desirable manner (e.g., with bolts, studs, or any other coupler).

Movement of the reciprocating element 202 away from the counterflow guide 214 increases a volume of the pumping chamber 208. As a result, a suction pressure is generated to draw fluid into the casing 206 via the first portion 2124 and to direct fluid through the counterflow guide 214 to force the valve 51 away from the counterflow guide 214, thereby enabling fluid flow into the pumping chamber 208. Movement of the reciprocating element 202 toward the counterflow guide 214 reduces a volume of the pumping chamber 208. Consequently, the reciprocating element 202 pressurizes the fluid and directs the fluid through the counterflow guide 214 to force the valve 52 away from the counterflow guide 214, thereby enabling fluid flow through the second portion 2126 to discharge the fluid out of the casing 206. The usage of a single counterflow guide 214 may improve an ease of manufacture of the fluid end 104. For example, the counterflow guide 214 functions to enable both suction and discharge of fluid with respect to the casing 206. Therefore, implementation of separate valve seats, among other components, dedicated for one of suction or discharge of fluid with respect to the casing 206 may be avoided. As such, a quantity of components of the fluid end 104 may be limited.

Additionally, a casing segment 35 is secured to the casing 206 and houses a packing assembly 36. A retaining element 37 is threadably coupled to the casing 206 and secures the packing assembly 36 within the casing segment 35. The reciprocating element 202 extends through the casing segment 35, the packing assembly 36, and the retaining element 37, and the packing assembly 36 is configured to seal against the reciprocating element 202 disposed interiorly of the packing assembly 36. Thus, the packing assembly 36 blocks fluid flow between the reciprocating element 202 and the casing segment 35, thereby forcing fluid flow within the pumping chamber 208 (e.g., for pressurization).

Figure 3:
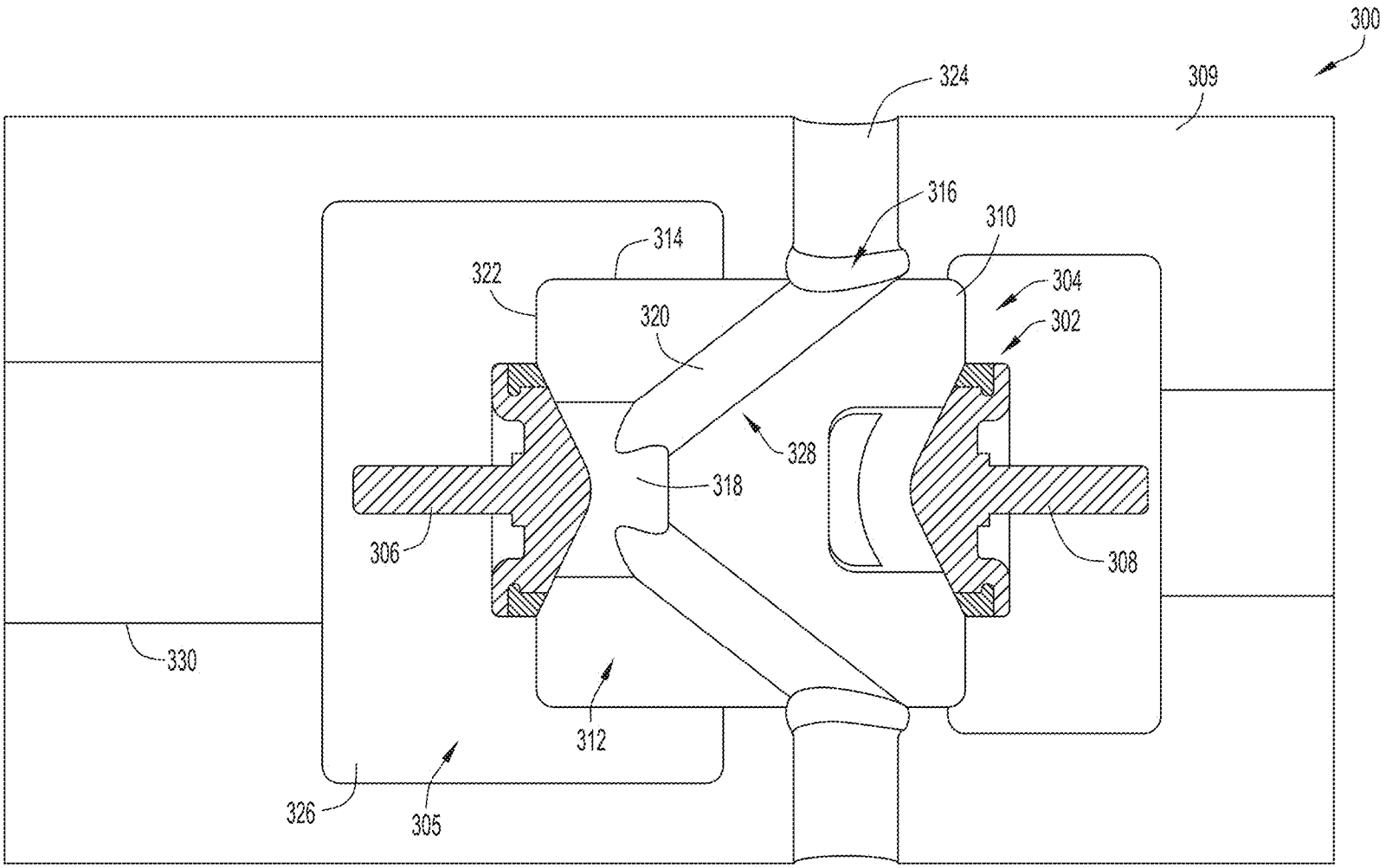
FIG. 3 is a side cross-sectional view of a fluid end with a counterflow guide assembly taken along a first perspective aligned with inlet portions of the counterflow guide assembly, in accordance with aspects of the present disclosure.

Turning to FIG. 3, a side cross-sectional view of a fluid end 300 with an embodiment of a counterflow guide assembly 302 is illustrated. The counterflow guide assembly 302 includes a counterflow guide 304, a first valve 306 (e.g., a first sealing valve, an intake valve), and a second valve 308 (e.g., a second sealing valve, a discharge valve) disposed within an interior 305 of a fluid end body 309 (e.g., a casing) of the fluid end 300. Each of first valve 306 and the second valve 308 is configured to engage with the counterflow guide 304. In some embodiments, the first valve 306 and the second valve 308 are of the same embodiment to reduce a quantity of different valve embodiments implemented in the counterflow guide assembly 302 to facilitate ease of manufacture of the counterflow guide assembly 302 (e.g., by reducing a quantity of different/unique manufacturing processes used to create the valves 306, 308). Thus, the same valve embodiment can be interchangeably used as the first valve 306 or the second valve 308. The counterflow guide 304 includes a guide body 310 (e.g., a flow core) that forms an interior 312 defining a flow path. The guide body 310 includes a sidewall 314 with valve suction inlets 316. The guide body 310 also defines a suction junction 318 (e.g., a valve suction outlet, a suction confluence bowl) and suction channels 320 (e.g., an intake port, an inlet channel) extending from the valve suction inlets 316 to the suction junction 318. The guide body 310 also includes a first end surface 322 (e.g., a suction surface) surrounding the suction junction 318. That is, the suction junction 318 is formed into the first end surface 322. The first valve 306 is configured to engage with the first end surface 322 and is exposed to (e.g., extends partially into) the suction junction 318 formed into the first end surface 322. Thus, the counterflow guide 304 may serve as a valve seat for the first valve 306.

The valve suction inlets 316 of the counterflow guide 304 are configured to align with corresponding fluid end inlets 324 formed through the fluid end body 309. During operation of the fluid end 300, a plunger or other reciprocating element is configured to move away from the counterflow guide 304 to draw fluid into the counterflow guide 304 via the fluid end inlets 324 and via the valve suction inlets 316, and the counterflow guide 304 directs the fluid from the valve suction inlets 316, through the suction channels 320, and to the suction junction 318, where the fluid is forced against the first valve 306 exposed to the suction junction 318. The fluid imparts a sufficient amount of pressure against the first valve 306 to drive the first valve 306 away from the guide body 310 to disengage from the first end surface 322, thereby creating a space between the first valve 306 and the first end surface 322. As a result, the fluid may flow out of the guide body 310 via the space and into a first chamber 326 (e.g., a suction chamber) of the fluid end body 309. Thus, the valve suction inlet 316, the suction channel 320, and the suction junction 318 cooperatively form a suction passage 328 configured to direct the fluid into the first chamber 326.

The first chamber 326 is a part of or is fluidly coupled to a pumping chamber 330 in which the fluid may be pressurized. For example, movement of the plunger toward the counterflow guide 304 reduces a volume of the pumping chamber 330 to pressurize the fluid within the pumping chamber 330. Additionally, movement of the plunger toward the counterflow guide 304 forces fluid against the first valve 306 toward the guide body 310 to cause the first valve 306 to engage with the first end surface 322, closing the first valve 306. The engagement of the first valve 306 against the first end surface 322 seals the suction junction 318 to block fluid flow into the suction junction 318, thereby forcing the fluid to remain within the first chamber 326 and/or within the pumping chamber 330 to facilitate pressurization of the fluid.

The illustrated counterflow guide 304 includes multiple valve suction inlets 316 and suction channels 320, each of which is fluidly connected to the same suction junction 318. Thus, during operation of the fluid end 300, the plunger is configured to draw multiple fluid flows into the counterflow guide 304 via the valve suction inlets 316 and suction channels 320, and the fluid flows combine at the suction junction 318 and at the first chamber 326 to further facilitate pressurization of the fluid. Additionally, the sidewall 314 and the first end surface 322 of the illustrated counterflow guide 304 extend crosswise (e.g., perpendicularly) to one another. As such, the suction channel 320 extends transverse to each of the sidewall 314 and the first end surface 322 to extend from the valve suction inlet 316 formed through the sidewall 314 to the suction junction 318 formed through the first end surface 322.

Figure 4:
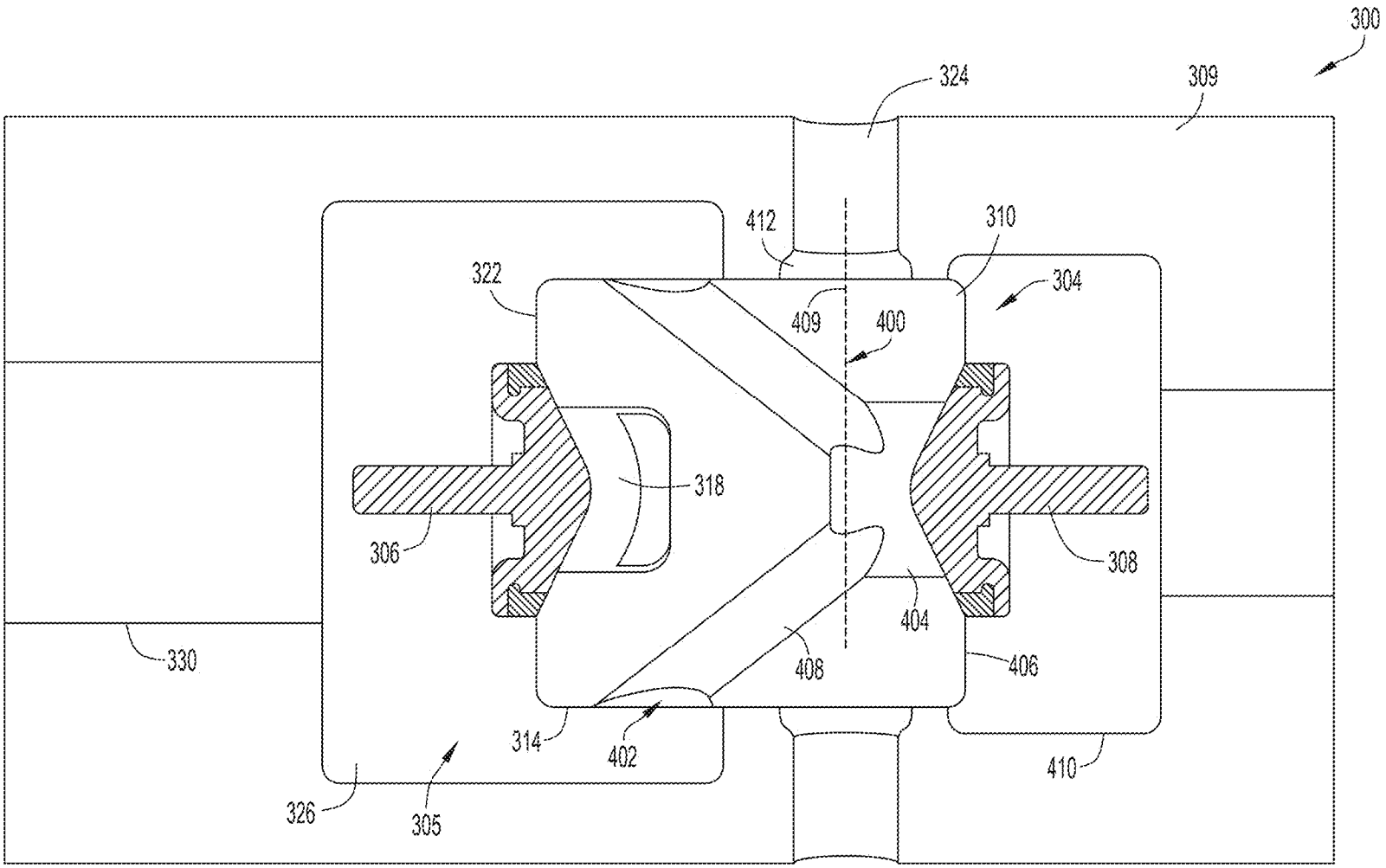
FIG. 4 is another side cross-sectional view of the fluid end with the counterflow guide assembly of FIG. 3, taken along a second perspective aligned with discharge portions of the counterflow guide assembly.

FIG. 4 is a side cross-sectional view of the counterflow guide assembly 302 illustrating a discharge passage 400 formed by the guide body 310 of the counterflow guide 304. In particular, the counterflow guide 304 includes valve discharge inlets 402 formed through the sidewall 314 of the guide body 310, as well as a discharge junction 404 (e.g., a valve discharge outlet, a discharge confluence bowl) formed through a second end surface 406 (e.g., a discharge surface), opposite the first end surface. The second valve 308 is configured to engage with the second end surface 406 and is exposed to (e.g., extends partially into) the discharge junction 404 to seal the discharge junction 404 during engagement with the second end surface 406. Discharge channels 408 (e.g., outlet channels) extend from the valve discharge inlets 402 to the discharge junction 404 in a direction that is transverse to the sidewall 314 and to the second end surface 406, which extend crosswise (e.g., perpendicularly) to one another. The valve discharge inlets 402, the discharge channels 408, and the discharge junction 404 cooperatively define the discharge passage 400. The suction junction 318 and the discharge junction 404 overlap with one another along an axis 409 extending along (e.g., parallel to) the first end surface 322 and/or the second end surface 406.

During operation of the fluid end 300, movement of the plunger toward the counterflow guide 304 to pressurize the fluid causes the first valve 306 to engage against the first end surface 322 and seal the suction junction 318. Thus, fluid flow into the suction junction 318 is blocked. Instead, the plunger may drive pressurized fluid into the guide body 310 via the valve discharge inlets 402, and the counterflow guide 304 directs the fluid from the valve discharge inlets 402, through the discharge channels 408, and into the discharge junction 404 (e.g., the same discharge junction for combining). Thus, the fluid directed into the discharge junction 404 imparts a force against the second valve 308 exposed to the discharge junction 404 to drive the second valve 308 away from the guide body 310 to disengage from the second end surface 406, thereby creating a space between the second valve 308 and the second end surface 406. As a result, the fluid may flow out of the counterflow guide 304 via the space and into a second chamber 410 (e.g., a discharge chamber) of the fluid end body 309. For instance, the second chamber 410 directs the fluid out of the fluid end 300.

The illustrated fluid end 300 also includes additional fluid end inlets 324 formed through the fluid end body. The additional fluid end inlets 324 face the sidewall 314 of the counterflow guide 304 and are fluidly coupled to the suction passage. For example, a channel 412 (e.g., an annular channel, a transition channel) is formed between the sidewall 314 and the fluid end body 310, and the channel 412 extends around the counterflow guide body 310 from the additional fluid end inlets 324 to the valve suction inlets 316 (see FIG. 3). Thus, fluid flowing into the fluid end 300 via the additional fluid end inlets 324 may flow through the channel 412 (e.g., along the sidewall 314) and into one of the valve suction inlets 316 (see FIG. 3) to flow into the counterflow guide 304. As such, the additional fluid end inlets 324 enable more fluid flows to be drawn into the counterflow guide 304 to combine and pressurize within the fluid end 300.

Figure 5:
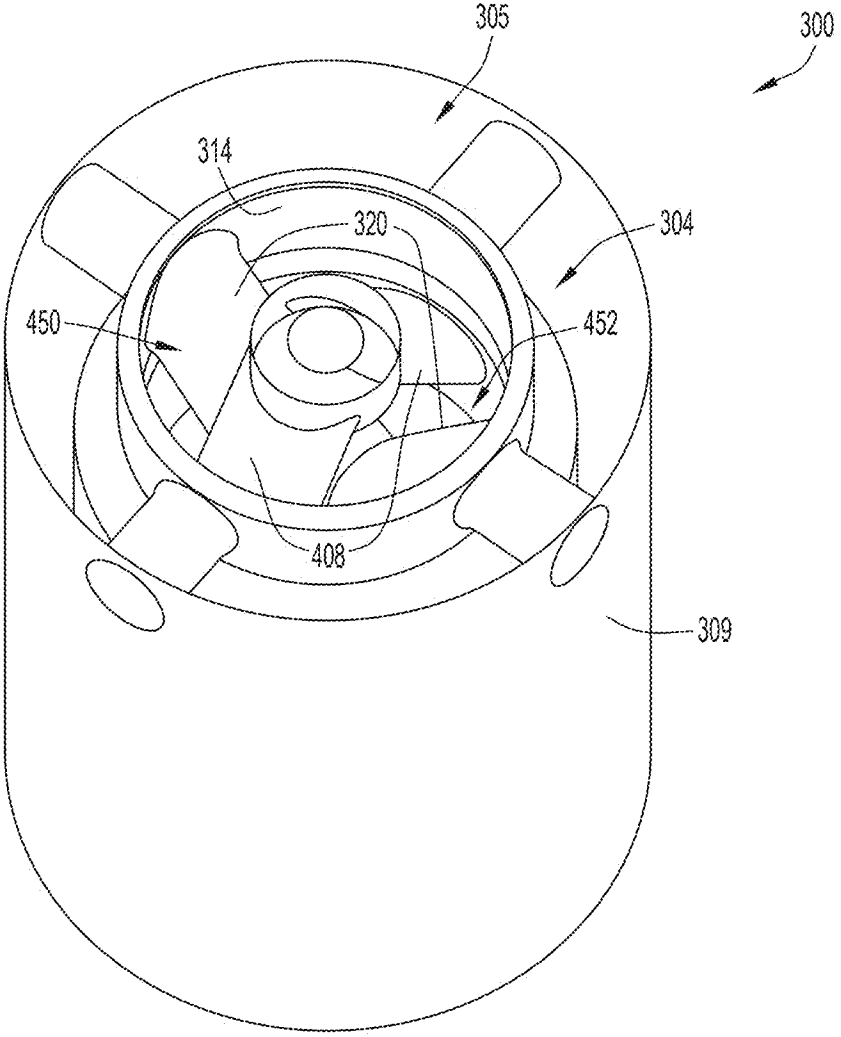
FIG. 5 is a perspective cross-sectional view of the fluid end with the counterflow guide assembly of FIG. 3, taken along a perspective that shows a suction chamber of the counterflow guide assembly.

FIG. 5 is a perspective cross-sectional view of the fluid end 300 with the counterflow guide 304. In the illustrated embodiment, the suction channels 320 and discharge channels 408 are each collectively oriented to form a v-shaped configuration. For example, the suction channels 320 extend at an acute angle relative to one another to provide a first space 450 between the suction channels 320, and the discharge channels 408 extend at an acute angle relative to one another to provide a second space 452 between the discharge channels. The suction channels 320 extend at least partially within the second space 452 between the discharge channels 408, and the discharge channels 408 extend at least partially within the first space 450 between the suction channels 320. As such, the first space 450 and the second space 452 may at least partially overlap with one another, and the suction channels 320 are geometrically skew to the discharge channels 408. Such orientation of the suction channels 320 relative to the discharge channels 408 may efficiently arrange the suction channels 320 and the discharge channels 408 within a limited amount of space to reduce a physical footprint occupied by the counterflow guide 304 having the suction channels 320 and discharge channels 408. For instance, the orientation of the suction channels 320 relative to the discharge channels 408 may enable the suction junction 318 and the discharge junction 404 to be arranged in overlap with one another along the axis 409 (see FIG. 4). Therefore, an available space within the interior 305 of the fluid end 300 in which the counterflow guide 304 is positioned may be more efficiently utilized. However, in additional or alternative embodiments, the suction channels 320 and the discharge channels 408 may be oriented in any other suitable manner relative to one another, such as in a parallel arrangement.

Figure 6:
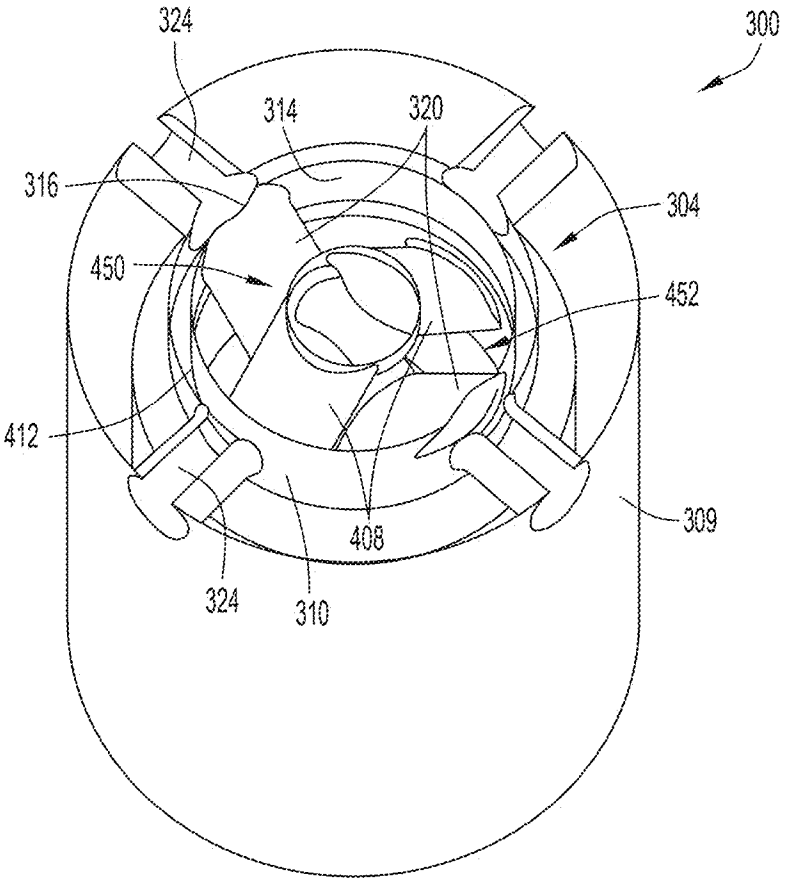
FIG. 6 is another perspective cross-sectional view of the fluid end with the counterflow guide assembly of FIG. 3, taken along a perspective that is parallel to but offset from the view of FIG. 5.

FIG. 6 is a perspective cross-sectional view of the fluid end 300 illustrating the channel 412 formed between the fluid end body 309 and the guide body 310. In particular, the channel 412 extends around the sidewall 314 to fluidly couple each of the fluid end inlets 324 to the passage and also to fluidly couple the channel 412 to the valve suction inlets 316. As such, each of the fluid end inlets 324 is fluidly coupled to the suction passage of the counterflow guide 304. For at least this reason, an increased quantity of fluid flows can be drawn into the fluid end 300 (e.g., into the first chamber 326 of FIGS. 3 and 4) via the counterflow guide 304 to improve efficient operation of the fluid end 300 to pressurize fluid.

Figure 7:
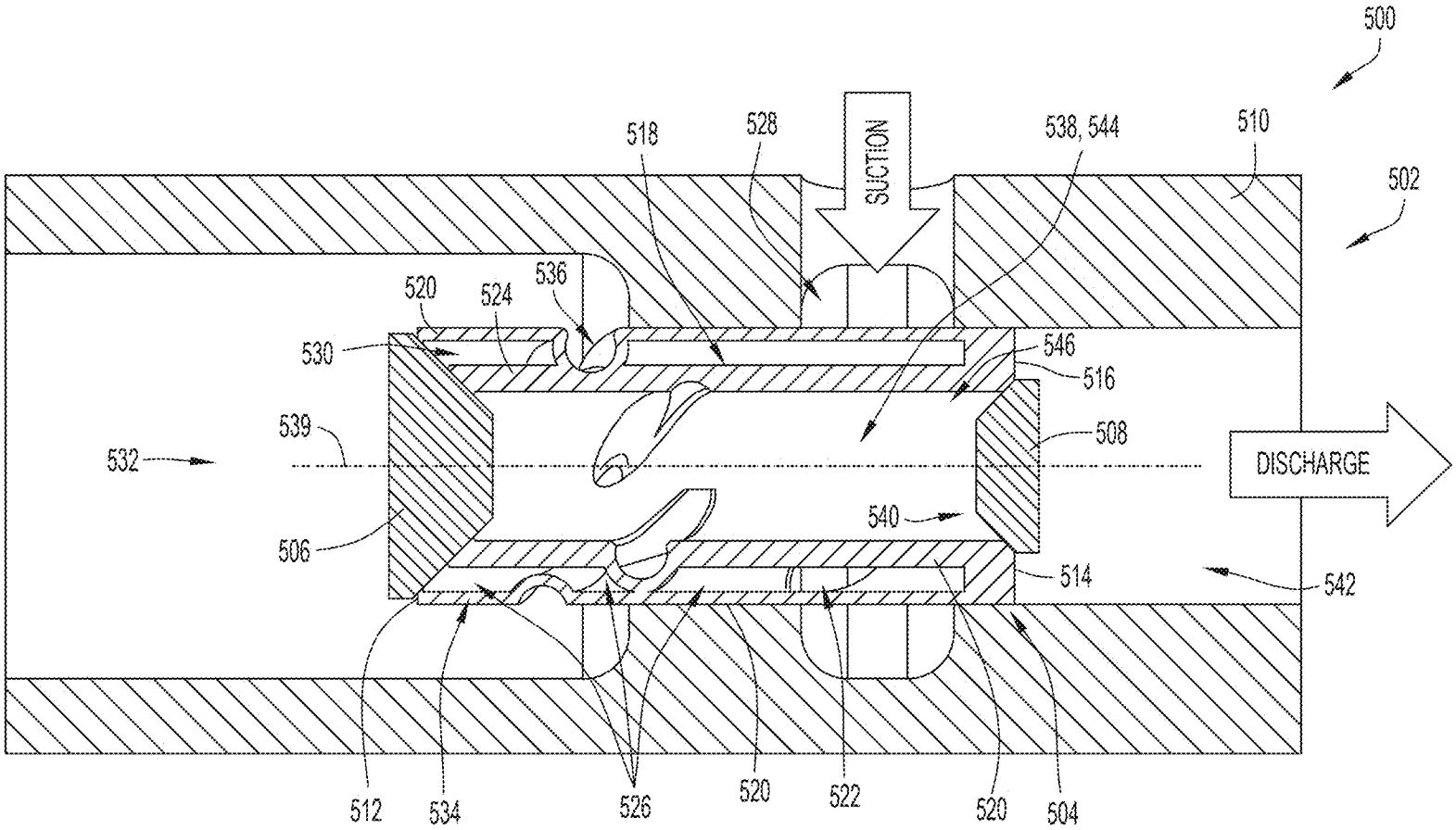
FIG. 7 is a side cross-sectional view of another fluid end with a counterflow guide assembly, in accordance with aspects of the present disclosure.

FIG. 7 is a side cross-sectional view of a fluid end 500 with another embodiment of a counterflow guide assembly 502. The counterflow guide assembly 502 includes a counterflow guide 504, a first valve 506 (e.g., a first sealing valve, an intake valve), and a second valve 508 (e.g., a second sealing valve, a discharge valve) disposed within an interior of a fluid end body 510 (e.g., a casing) of the fluid end 500. The first valve 506 is configured to engage with a first end surface 512 of the counterflow guide 504, and the second valve 508 is configured to engage with a second end surface 514, opposite the first end surface 512, of the counterflow guide 504. Although the first valve 506 and the second valve 508 have different profiles in the illustrated embodiments, in additional or alternative embodiments, the valve 506, 508 are of the same embodiment that can be interchangeably used. The counterflow guide 504 includes a guide body 516 (e.g., a flow core) that forms an interior 518 defining a flow path. For example, the guide body 516 includes a first sidewall 520 (e.g., an exterior sidewall, an outer sidewall, a peripheral sidewall) through which valve suction inlets 522 (e.g., intake ports) are formed. The guide body 516 also includes a second sidewall 524 (e.g., an interior sidewall, an inner sidewall, a core sidewall) positioned interior to and offset from the first sidewall 520. Thus, the first sidewall 520 and the second sidewall 524 cooperatively form a suction channel 526 (e.g., an inlet channel) through which fluid may flow. In the depicted embodiment, this suction channel 526 is generally annular.

Movement of a plunger or reciprocating element of the fluid end 500 away from the counterflow guide 504 draws fluid into the fluid end 500 via fluid end inlets 528 formed through the fluid end body 510. The valve suction inlets 522 are exposed to the fluid end inlets 528 and receive the fluid drawn into the fluid end 500. The suction channel 526 extends from the valve suction inlets 522 to the first end surface 512. Thus, the valve suction inlets 522 direct the fluid to the suction channel 526, and the suction channel 526 directs the fluid to valve suction outlets 530 formed into the first end surface 512 of the counterflow guide. The first valve 506 covers and seals the valve suction outlets 530 while engaged with the first end surface 512. Thus, fluid directed to the valve suction outlets 530 is forced against the first valve 506 to drive the first valve 506 away from the counterflow guide 504 to disengage from the first end surface 512. Consequently, a space is formed between the first end surface 512 and the first valve 506 to enable fluid flow therethrough. For example, fluid may flow out of the counterflow guide 504 via the valve suction outlets 530 and into a first chamber 532 (e.g., a suction chamber) of the fluid end body 510 for pressurization. Thus, the valve suction inlets 522, the suction channel 526, and the valve suction outlets 530 cooperatively form a suction passage 534 for directing fluid into the first chamber.

The counterflow guide 504 also includes valve discharge inlets 536 formed through the first sidewall 520. The valve discharge inlets 536 are exposed to the first chamber 532 and therefore are configured to receive fluid from the first chamber 532. Additionally, a bore 538 (e.g., a central bore) is formed through the first end surface 512 and through the second end surface 514 interior of both sidewalls 520, 524. For example, a central axis 539 extends through each of the end surfaces 512, 514, and the bore 538 extends along the central axis 539. The valve discharge inlets 536 extend from the first sidewall 520 into the bore 538 and are configured to direct fluid from the first chamber 532 into and combine within the bore 538. The bore 538 includes or is fluidly coupled to a valve discharge outlet 540 (e.g., formed through the second end surface) for directing fluid out of the counterflow guide 504 and into a second chamber 542 (e.g., a discharge chamber). As such, the bore 538 provides a discharge channel 544 (e.g., an outlet channel) for the fluid. Thus, the valve discharge inlets 536, the bore 538, and the valve discharge outlet 540 form a discharge passage 546 of the counterflow guide 504.

Movement of the plunger toward the counterflow guide 504 forces fluid (e.g., pressurized fluid) against the first valve 506 into engagement with the first end surface 512. Therefore, fluid flow into the valve suction outlets 530 is blocked. Instead, fluid is forced from the first chamber 532 into the valve discharge inlets 536, and the valve discharge inlets 536 direct the fluid into the bore 538. The bore 538 then directs the fluid to the valve discharge outlet 540. The second valve 508 positioned in engagement with the second end surface 514 seals and is exposed to (e.g., extends partially into) the valve discharge outlet 540. As such, fluid directed to the valve discharge outlet 540 drives the second valve 508 away from the counterflow guide 504 to disengage from the second end surface 514 and provide a space between the second valve 508 and the second end surface 514. Fluid may then flow out of the counterflow guide 504 via the space and into the second chamber 542.

In some embodiments, the valve suction inlet 522, the suction channel 526, and/or the valve discharge inlet 536 generally extend in a helical or spiral arrangement along the counterflow guide 504 (e.g., along a circumference of the sidewalls 520, 524, about the bore 538, around the central axis 539). Thus, fluid may flow in a swirling direction into the first chamber 532 and/or into the second chamber 542. In at least some instances, the helical flow may reduce turbulence and enhance pump performance by controlling fluid flow more desirably (e.g., by improving stable fluid flow into the first chamber 532 and/or into the second chamber 542).

Figure 8:
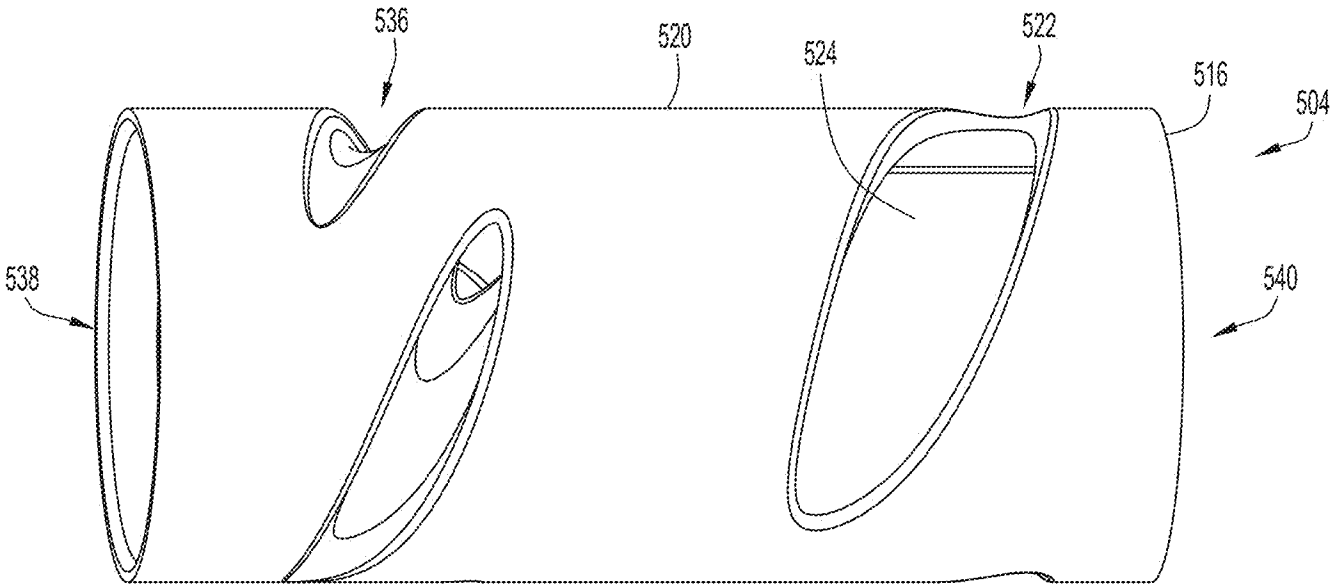
FIG. 8 is a side view of the counterflow guide of FIG. 7.

FIG. 8 is a side view of the counterflow guide 504 further illustrating the valve suction inlets and the valve discharge inlets 522 formed through the guide body 516 and extending helically along the counterflow guide 504. The valve suction inlets 522 are formed through the first sidewall 520, but not through the second sidewall 524. In other words, the valve suction inlets 522 extend up to the second sidewall 524. Thus, fluid entering the counterflow guide 504 via the valve suction inlets 522 flow into the suction channel 526 (see FIG. 7) between the first sidewall 520 and the second sidewall 524 and then around/along the second sidewall 524 to flow toward the valve suction outlets 530 (see FIG. 7).

Additionally, the valve discharge inlets 536 are formed through the first sidewall 520 and through the second sidewall 524. Accordingly, the valve discharge inlets 536 extend up to the bore 538 disposed interior of the second sidewall. Therefore, fluid entering the counterflow guide 504 via the valve discharge inlets 536 flow into the bore 538 to flow toward the valve discharge outlet 540.

Figure 9:
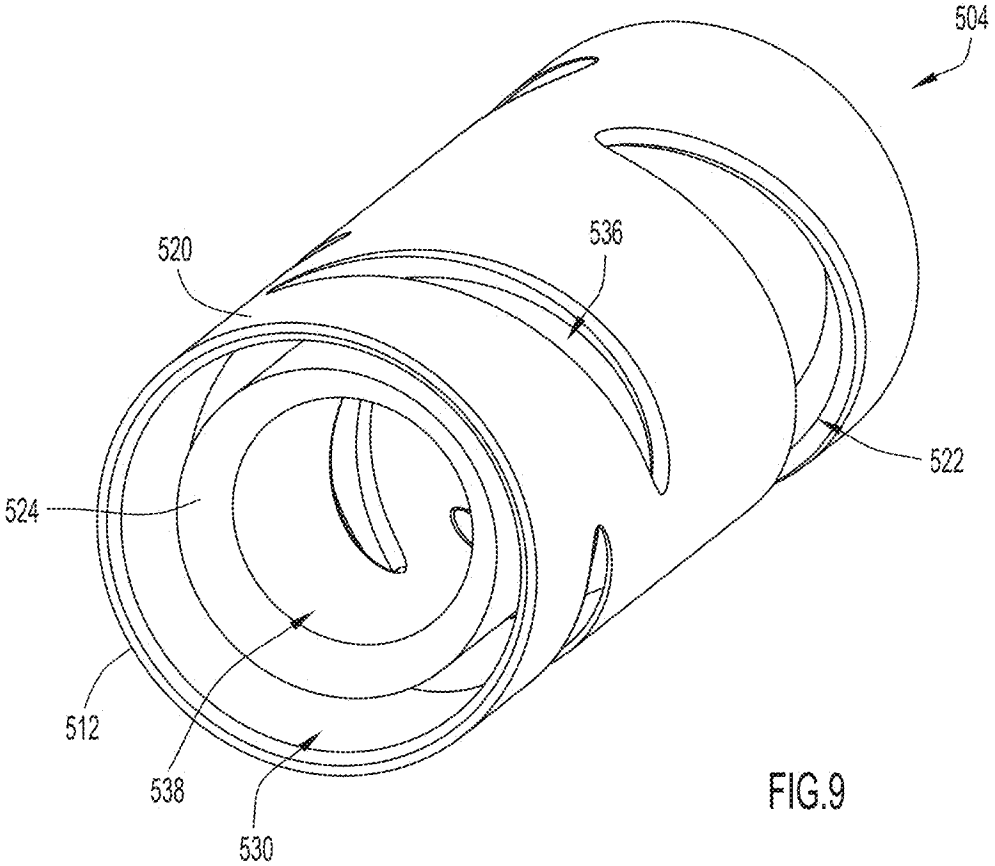
FIG. 9 is a perspective view of the counterflow guide of FIG. 7.

FIG. 9 is a perspective view of the counterflow guide 504 providing visualization of the first end surface 512. For example, FIG. 9 illustrates the valve suction outlets 530 formed into the first end surface 512 between the first sidewall 520 and the second sidewall 524. Additionally, the bore 538 is formed into the first end surface 512 interior of the second sidewall 524. Thus, each of the valve suction outlets 530 and the bore 538 is fluidly connected to the first chamber 532 of the fluid end 500 (see FIG. 7) to which the first end surface 512 is exposed. As an example, the valve suction outlets 530 are configured to direct fluid into the first chamber 532 (e.g., from the suction channel), and the bore 538 is configured to receive fluid from the first chamber 532 (e.g., for directing to the valve discharge outlet).

Figure 10:
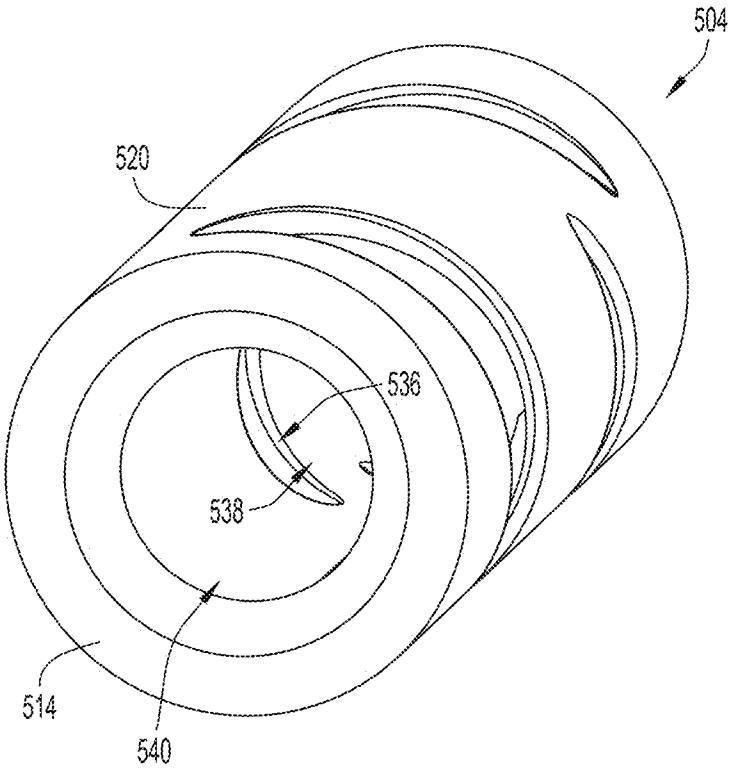
FIG. 10 is another perspective view of the counterflow guide of FIG. 7.

FIG. 10 is a perspective view of the counterflow guide 504 providing visualization of the second end surface 514. For instance, FIG. 10 illustrates the valve discharge outlet 540 formed into the second end surface 514, as well as valve discharge inlets 536 extending to the bore 538. Thus, the valve discharge inlets 536 are configured to direct fluid to the bore 538, and the bore 538 is configured to direct the fluid to the valve discharge outlet 540 toward the second chamber 542 (see FIG. 7) to which the second end surface 514 is exposed.

Figure 11:
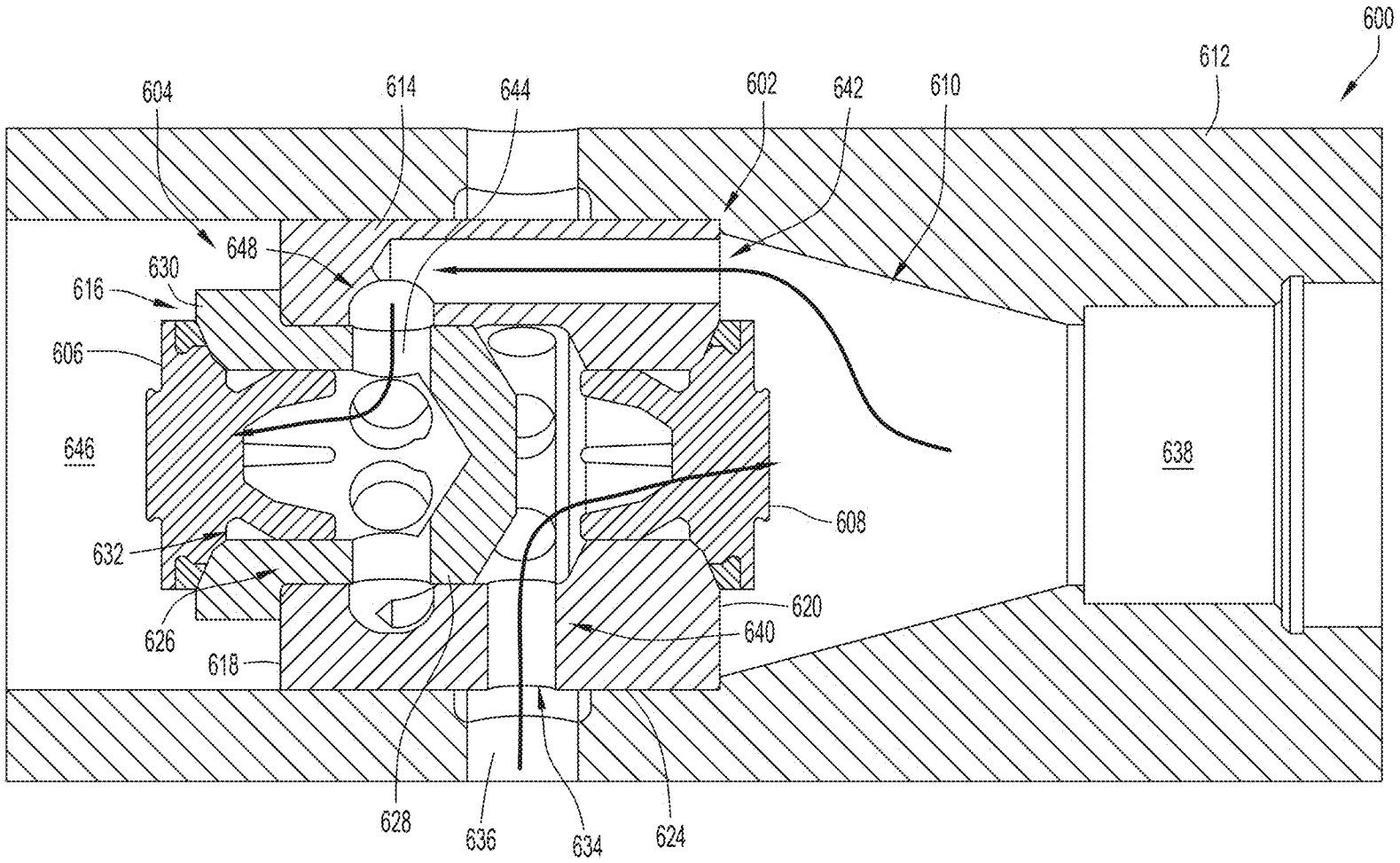
FIG. 11 is a side cross-sectional view of yet another fluid end with a counterflow guide assembly, in accordance with aspects of the present disclosure.

FIG. 11 is a side cross-sectional view of a fluid end 600 with a counterflow guide assembly 602. The counterflow guide assembly 602 includes a counterflow guide 604, a first valve 606 (e.g., a first sealing valve, an intake valve), and a second valve 608 (e.g., a second sealing valve, a discharge valve) disposed within an interior 610 of the fluid end body 612 (e.g., a casing) of the fluid end 600. The first valve 606 and the second valve 608 may be of the same valve embodiment that can interchangeably used. The counterflow guide 604 includes a primary guide body 614 and a secondary guide body 616 configured to couple to one another. For example, the primary guide body 614 includes a first end surface 618 and a second end surface 620 opposite the first end surface 618, as well as a sidewall 624 connecting the first end surface 618 and the second end surface 620 to one another. A first opening 626 is formed through the first end surface 618 and through the second end surface 620. The secondary guide body 616 includes an insert 628 and a flange 630 extending outward from the insert 628. The insert 628 of the secondary guide body 616 is configured to extend into the first opening 626 of the primary guide body 614 at the first end surface 618 to abut the flange 630 against the first end surface 618. As a result, the primary guide body 614 captures the insert 628 to secure the secondary guide body 616 within the primary guide body 614. A second opening 632 is formed into the flange 630 of the secondary guide body 616, and the first valve 606 is configured to engage with the flange 630 and extend into the second opening 632 to couple to the counterflow guide 604 and seal the second opening 632. Accordingly, the secondary guide body 616 and the first valve 606 cooperatively seal the first opening 626 at the first end surface 618. Meanwhile, the second valve 608 is configured to engage with the second end surface 620 of the primary guide body 614 and extend into the first opening 626 at the second end surface 620 to couple to the counterflow guide 604 and seal the first opening 626 at the second end surface 620.

Valve suction inlets 634 (e.g., intake ports) are formed into the sidewall 624 of the primary guide body. The valve suction inlets 634 are exposed to fluid end inlets 636 formed through the fluid end body 612 and are fluidly coupled to the first opening 626. Thus, movement of a plunger or other reciprocating element of the fluid end 600 away from the counterflow guide 604 draws fluid into the fluid end 600 via the fluid end inlets 636 and into the counterflow guide 604 via the valve suction inlets 634. The valve suction inlets 634 then direct the fluid to the first opening 626. The insert 628 of the secondary guide body 616 forms a seal with the primary guide body 614 to seal the first opening 626 at the first end surface 618 and block fluid flow from the valve suction inlets 634 toward the first end surface 618. As such, fluid is forced toward the second end surface 620 and against the second valve 608 to drive the second valve 608 away from the counterflow guide 604 and disengage from the second end surface 620, thereby creating a space between the second valve 608 and the second end surface 620. As a result, fluid may flow out of the counterflow guide 604 via the space between the second valve 608 and the second end surface 620, such as into a first chamber 638 (e.g., a suction chamber, a plunger chamber) exposed to the second end surface 620. Thus, the valve suction inlets 634 and the first opening 626 at the second end surface 620 cooperatively form a suction passage 640 for directing fluid into the first chamber 638.

A valve discharge inlet 642 is formed through the second end surface 620, and the valve discharge inlet 642 is fluidly coupled to the first opening 626 near the first end surface 618. Thus, the valve discharge inlet 642 is configured to direct fluid from the first chamber 638 to the first opening 626 and toward the first end surface 618. For instance, movement of the plunger toward the counterflow guide 604 drives the fluid (e.g., pressurized fluid) against the second valve 608 to place the second valve 608 in engagement with the second end surface 620 to seal the first opening 626 at the second end surface 620 and block fluid flow from the first chamber 638 toward the valve suction inlets 634 and force fluid flow from the first chamber 638 into the valve discharge inlet 642 and to the first opening 626. In addition, the insert 628 of the secondary guide body 616 blocks fluid flow from the valve discharge inlet 642 toward the second end surface 620. Instead, the fluid is forced into holes 644 formed through the insert 628 and through the second opening 632 of the secondary guide body 616. As a result, fluid is forced against the first valve 606 extending into the second opening 632 to move the first valve 606 away from the secondary guide body 616 to disengage from the flange 630, thereby creating a space between the first valve 606 and the flange 630. The fluid may then flow out of the counterflow guide 604 via the space between the first valve 606 and the flange 630, such as into a second chamber 646 (e.g., a discharge chamber) exposed to the first end surface 618 and to the flange 630. Thus, the second opening 632 functions as a valve discharge outlet for directing fluid out of the counterflow guide 604, and the valve discharge inlet 642, the holes 644 of the insert 628 of the secondary guide body 616, the first opening 626 fluidly coupled to the holes 644 near the first end surface 618, and the second opening cooperatively form a discharge passage 648 for directing fluid into the second chamber 646.

Although the illustrated counterflow guide 604 includes separate valve bodies to form the suction passage 640 and the discharge passage 648, in additional or alternative embodiments, the counterflow guide 604 may include a single, integral guide body. For example, the integrated counterflow guide may include a valve suction inlet and a valve suction outlet that cooperatively form the suction passage 640, as well as a valve discharge inlet and a valve discharge outlet that cooperatively form the discharge passage 648. In such embodiments, the first valve 606 and the second valve 608 may be exposed to (e.g., extend partially into) the valve suction outlet and the valve discharge outlet, respectively.

Figure 12:
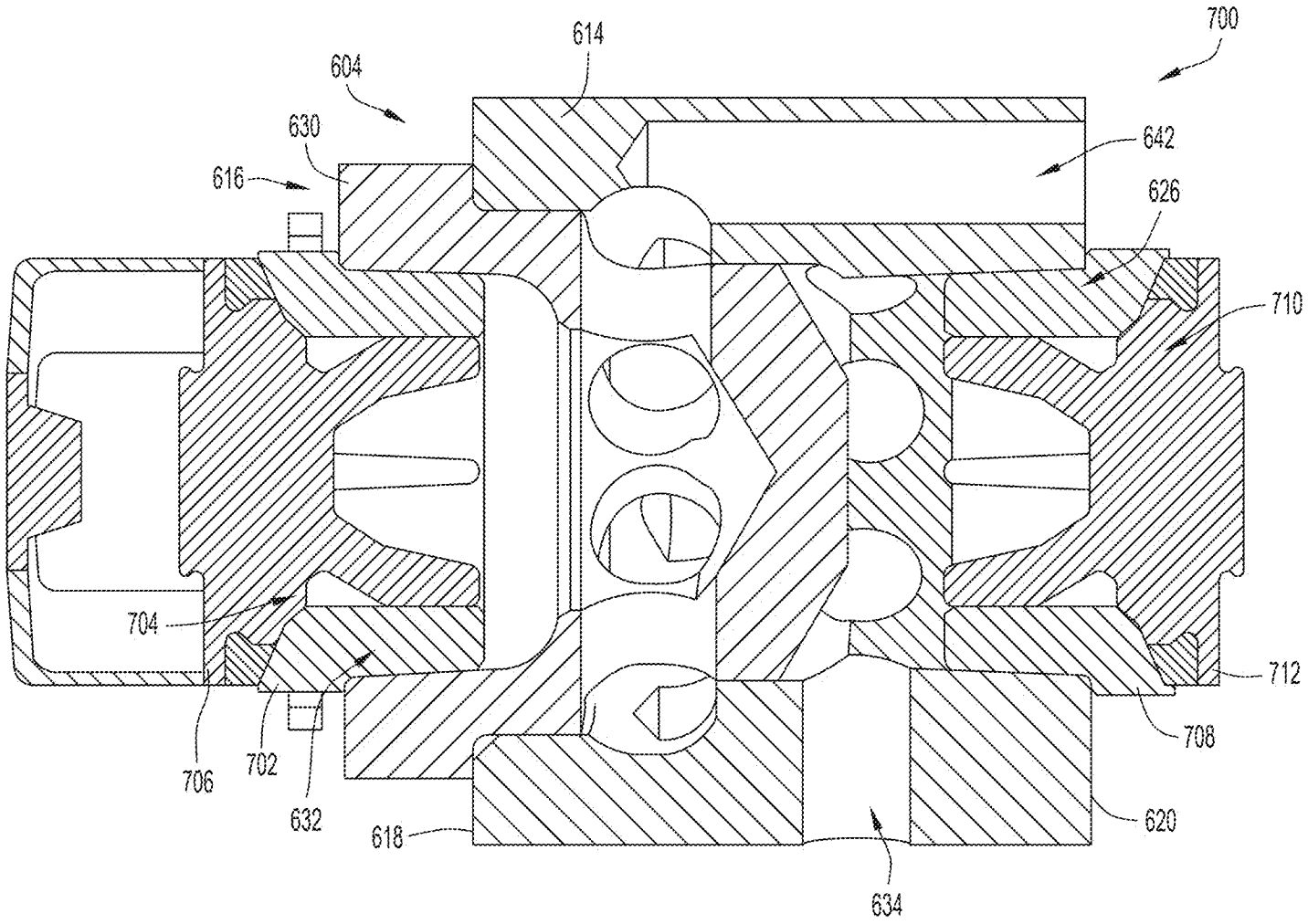
FIG. 12 is a side cross-sectional view of another counterflow guide assembly, in accordance with aspects of the present disclosure.

FIG. 12 is a side cross-sectional view of a counterflow guide assembly 700. The counterflow guide assembly 700 includes the counterflow guide 604 of FIG. 11. Additionally, the counterflow guide assembly 700 includes a first seat 702 configured to extend into the second opening 632 of the secondary guide body 616 and engage with the flange 630 of the secondary guide body 616. The first seat 702 is secured within the secondary guide body 616 (e.g., via an interference fit) and includes a first bore 704, and a first valve 706 (e.g., a first sealing valve, an intake valve, the first valve 606) is exposed to (e.g., extends partially into) the first bore 704 and is configured to engage with the first seat 702. The counterflow guide assembly 700 further includes a second seat 708 configured to extend into the first opening 626 of the primary guide body 614 and engage with the second end surface 620 of the primary guide body 614. The second seat 708 is secured within the primary guide body 614 (e.g., via an interference fit) and includes a second bore 710, and a second valve 712 (e.g., a second sealing valve, a discharge valve, the second valve 608) is exposed to (e.g., extends partially into) the second bore 710 and is configured to engage with the second seat 708.

Engagement of the second valve 712 against the second seat 708 seals the second seat 708 to block fluid flow between the second bore 710 and a first chamber (e.g., a suction chamber, a plunger chamber) exposed to the second end surface 620 and the second seat 708. However, disengagement of the second valve 712 from the second seat 708 provides a space between the second valve 712 and the second seat 708 that enables fluid flow between the second bore 710 and the first chamber. For example, movement of a plunger or reciprocating pump away from the counterflow guide 604 forces fluid through the valve suction inlet 634, through the first opening 626, and into the second bore 710 of the second seat 708 to force the fluid against the second valve 712, thereby driving the second valve 712 away from the second seat 708 to provide the space between the second valve 712 and the second seat 708. Further, engagement of the first valve 706 against the first seat 702 seals the first bore 704 to block fluid flow between the first bore 704 and a second chamber (e.g., a discharge chamber) exposed to the first end surface 618, the flange 630, and the first seat 702. Disengagement of the first valve 706 from the first seat 702 provides a space between the first valve 706 and the first seat 702 that enables fluid flow between the first bore 704 and the second chamber. For instance, movement of the plunger toward the counterflow guide 604 forces fluid through the valve discharge inlet 642, through the first opening 626 of the primary guide body 614 near the first end surface 618, through the second opening 632 of the secondary guide body 616, and into the first bore 704 of the first seat 702 via the first bore 704 to force the fluid against the first valve 706, thereby driving the first valve 706 away from the first seat 702 to provide the space between the first valve 706 and the first seat 702.

The seats 702, 708 enable operation of the valves 706, 712 to selectively allow fluid flow through the counterflow guide 604. However, the seats 702, 708 block direct contact between the valves 706, 712 and the counterflow guide 604. For example, opening/closing of the valves 706, 712 may place the valves 706, 712 into contact with the seats 702, 708 instead. Thus, wear of the counterflow guide 604 (e.g., of the flange 630 of the secondary guide body 616, of the second end surface 620 of the primary guide body 614) that may otherwise be caused by repeated contact (e.g., collision) with the valves 706, 712 may be reduced. Consequently, a structural integrity of the counterflow guide 604 may be maintained to improve an ease of performing maintenance (e.g., inspection, replacement, repair). By way of example, it may be more difficult to access the counterflow guide 604 as compared to the seats 702, 708. Therefore, the seats 702, 708 may be more easily/readily accessed to complete maintenance of the counterflow guide 604.

While the apparatuses presented herein have been illustrated and described in detail and with reference to specific embodiments thereof, it is nevertheless not intended to be limited to the details shown, since it will be apparent that various modifications and structural changes may be made therein without departing from the scope of the disclosure and within the scope and range of equivalents of the claims. For example, any of the components described herein may be modified to be of any shape.

In addition, various features from one of the embodiments may be incorporated into another of the embodiments. That is, it is believed that the disclosure set forth above encompasses multiple distinct embodiments with independent utility. While each of these embodiments has been disclosed in a preferred form, the specific embodiments thereof as disclosed and illustrated herein are not to be considered in a limiting sense as numerous variations are possible. The subject matter of the embodiments includes all novel and non-obvious combinations and subcombinations of the various elements, features, functions, and/or properties disclosed herein. Accordingly, it is appropriate that the appended claims be construed broadly and in a manner consistent with the scope of the disclosure as set forth in the following claims.

It is also to be understood that terms such as "left," "right," "top," "bottom," "front," "rear," "side," "height," "length," "width," "upper," "lower," "interior," "exterior," "inner," "outer" and the like as may be used herein, merely describe points of reference and do not limit the present disclosure to any particular orientation or configuration. Further, the term "exemplary" is used herein to describe an example or illustration. Any embodiment described herein as exemplary is not to be construed as a preferred or advantageous embodiment, but rather as one example or illustration of a possible embodiment of the disclosure. Additionally, it is also to be understood that the components discussed herein may be fabricated from any suitable material or combination of materials, such as, but not limited to, plastics, metals (e.g., nickel, copper, bronze, aluminum, steel, etc.), metal alloys, elastomeric materials, etc., as well as derivatives thereof, and combinations thereof, unless otherwise specified. In addition, it is further to be understood that the steps of the methods described herein may be performed in any order or in any suitable manner.

Finally, when used herein, the term "comprises" and its derivations (such as "comprising", etc.) should not be understood in an excluding sense, that is, these terms should not be interpreted as excluding the possibility that what is described and defined may include further elements, steps, etc. Similarly, where any description recites "a" or "a first" element or the equivalent thereof, such disclosure should be understood to include incorporation of one or more such elements, neither requiring nor excluding two or more such elements. Meanwhile, when used herein, the term "approximately" and terms of its family (such as "approximate", etc.) should be understood as indicating values very near to those which accompany the aforementioned term. That is to say, a deviation within reasonable limits from an exact value should be accepted, because a skilled person in the art will understand that such a deviation from the values indicated is inevitable due to measurement inaccuracies, etc. The same applies to the terms "about", "around", "generally", and "substantially."

What is claimed is:

1. A counterflow guide, comprising:

a body comprising a first end surface, a second end surface positioned opposite the first end surface, and a sidewall connecting the first end surface to the second end surface;

a bore extending through the first end surface and the second end surface to extend through the body, wherein the bore is configured to direct a fluid to discharge through the body; and a discharge channel extending through the sidewall to the bore, wherein the discharge channel is configured to direct the fluid into the bore extending through the body.

2. The counterflow guide of claim 1, comprising:

a suction channel extending from a suction inlet to a suction outlet, wherein the suction inlet is formed into the sidewall, and the suction outlet is formed into the second end surface.

3. The counterflow guide of claim 2, wherein the suction channel extends along the bore.

4. The counterflow guide of claim 1, wherein the bore is a central bore positioned interiorly of the sidewall.

5. The counterflow guide of claim 1, wherein the discharge channel extends helically around a circumference of the sidewall to the bore.

6. The counterflow guide of claim 5, comprising:

a suction channel that extends from a suction inlet to a suction outlet, wherein the suction inlet is formed into the sidewall, and the suction outlet is formed into the second end surface.

7. The counterflow guide of claim 6, comprising:

an additional sidewall positioned interior of the sidewall, wherein the bore extends through the first end surface to the second end surface within the additional sidewall, and the suction channel extends between the sidewall and the additional sidewall.

8. The counterflow guide of claim 7, wherein the discharge channel extends through the additional sidewall to extend to the bore.

9. The counterflow guide of claim 6, wherein the suction channel extends along the sidewall.

10. A counterflow guide, comprising:

a body comprising a first end surface, a second end surface positioned opposite the first end surface, a sidewall connecting the first end surface and the second end surface to one another, an additional sidewall extending interiorly of the sidewall to form a suction channel between the sidewall and the additional sidewall, and a bore extending interiorly of the additional sidewall;

a suction passage configured to direct fluid from the sidewall, through the suction channel, and out of the body at the first end surface; and a discharge passage configured to direct fluid from the sidewall, through the bore, and out of the body at the second end surface.

11. The counterflow guide of claim 10, wherein a central axis extends through each of the first end surface and the second end surface, and the bore extends along the central axis.

12. The counterflow guide of claim 11, wherein the suction passage comprises:

a suction inlet formed in the sidewall of the body; and a helical channel extending around the central axis from the suction inlet to the first end surface.

13. The counterflow guide of claim 12, wherein the helical channel extends between the sidewall and the bore.

14. The counterflow guide of claim 10, wherein the suction passage comprises a suction channel extending through the sidewall but not through the additional sidewall.

15. The counterflow guide of claim 10, wherein the discharge passage comprises a discharge channel extending through the sidewall and the additional sidewall into the bore.

16. The counterflow guide of claim 10, comprising:

an additional discharge passage configured to direct fluid from the sidewall, through the bore and out of the body at the second end surface.

17. A counterflow guide assembly, comprising:

a counterflow guide comprising a first end surface, a second end surface positioned opposite the first end surface, a sidewall connecting the first end surface and the second end surface to one another, an additional sidewall extending interiorly of the sidewall to form a suction channel between the sidewall and the additional sidewall, a bore extending interiorly of the additional sidewall, and a discharge channel extending through the sidewall and the additional sidewall into the bore;

a first valve configured to seal an opening formed into the first end surface of the counterflow guide; and a second valve configured to seal an additional opening formed into the second end surface of the counterflow guide.

18. The counterflow guide assembly of claim 17, wherein the first valve and the second valve are of the same valve embodiment.

19. The counterflow guide assembly of claim 17, wherein the counterflow guide comprises a plurality of discharge channels including the discharge channel, and each discharge channel of the plurality of discharge channels extends through the sidewall and the additional sidewall into the bore.

20. The counterflow guide assembly of claim 17, wherein the suction channel extends through the first end surface, and the bore extends through the second end surface.

* * * * *